US009204736B2

(12) United States Patent
Lindblom et al.

(10) Patent No.: US 9,204,736 B2
(45) Date of Patent: Dec. 8, 2015

(54) SHELVING UNIT LIGHTING SYSTEM

(71) Applicant: Streater LLC, Albert Lea, MN (US)

(72) Inventors: Thomas G. Lindblom, Claremont, MN (US); Peter K. Nelson, Hartland, MN (US)

(73) Assignee: STREATER LLC, Albert Lea, MN (US)

( * ) Notice: Subject to any disclaimer, the term of this patent is extended or adjusted under 35 U.S.C. 154(b) by 214 days.

(21) Appl. No.: 13/947,600

(22) Filed: Jul. 22, 2013

(65) Prior Publication Data

US 2014/0055987 A1 Feb. 27, 2014

Related U.S. Application Data

(60) Provisional application No. 61/692,054, filed on Aug. 22, 2012.

(51) Int. Cl.
*A47F 11/10* (2006.01)
*A47F 3/00* (2006.01)

(52) U.S. Cl.
CPC ..... *A47F 3/001* (2013.01); *A47F 11/10* (2013.01); *A47B 2220/0077* (2013.01)

(58) Field of Classification Search
CPC ..... F21S 2/00; F21S 8/00; F21S 4/003; A47F 5/0018; A47F 5/103; A47F 5/0892; A47F 5/0025; A47F 5/0043; A47B 97/00; A47B 96/02; H01R 25/14; H01R 25/162; H01R 25/145
USPC ..... 362/125, 133, 134
See application file for complete search history.

(56) References Cited

U.S. PATENT DOCUMENTS

| | | | | |
|---|---|---|---|---|
| 4,689,726 | A * | 8/1987 | Kretzschmar | 362/127 |
| 5,915,824 | A * | 6/1999 | Straat | 362/133 |
| 6,196,648 | B1 * | 3/2001 | Henriott | A47B 21/06 108/103 |
| 6,231,205 | B1 * | 5/2001 | Slesinger et al. | 362/133 |
| 6,918,679 | B2 * | 7/2005 | Wu | 362/127 |
| 2005/0254262 | A1 * | 11/2005 | Chiu | 362/648 |
| 2006/0207778 | A1 * | 9/2006 | Walter | 174/19 |
| 2007/0290585 | A1 * | 12/2007 | Moeller | A47F 3/004 312/234 |
| 2010/0102685 | A1 * | 4/2010 | Ward | A47B 81/00 312/7.2 |
| 2012/0230018 | A1 * | 9/2012 | Wiemer et al. | 362/133 |
| 2013/0286651 | A1 * | 10/2013 | Takeuchi | 362/249.02 |
| 2013/0299439 | A1 * | 11/2013 | Sid et al. | 211/134 |

* cited by examiner

*Primary Examiner* — Nimeshkumar Patel
*Assistant Examiner* — Kevin Quarterman
(74) *Attorney, Agent, or Firm* — Nikolai & Mersereau, P.A.; Thomas J. Nikolai

(57) ABSTRACT

A modular system for illuminating store shelving includes one or more power supplies hidden from view to power vertically extending tracks which power light assemblies attached to the shelves. Wire management tracks are also provided so there are no dangling wires extending from the tracks to the light assemblies and all wires are generally hidden from view.

10 Claims, 6 Drawing Sheets

SHELVING UNIT LIGHTING SYSTEM

CROSS-REFERENCED TO RELATED APPLICATIONS

This application is a non-provisional application of provisional Application No. 61/692,054, filed Aug. 22, 2012 and claims priority from that application which is also deemed incorporated by reference in its entirety in this application.

STATEMENT REGARDING FEDERALLY SPONSORED RESEARCH OR DEVELOPMENT

Not applicable.

BACKGROUND OF THE INVENTION

I. Field of the Invention

This invention relates generally to lighting systems and more particularly to lighting systems for display cases and shelving unites for merchandise.

II. Discussion of the Prior Art

Various forms of lighting have been employed in retail establishments. Lighting is used on signage, to provide security, to accent and better display product features, to enhance the prominence and attractiveness of merchandise, and to affect the mood of customers. The eye is drawn to brighter areas of contrasting light. Reading of packaging and labeling is easier in well lighted areas.

Many retail establishments employ overhead ambient light sources and shelving units for holding merchandise which incorporate a plurality of vertically arranged shelves which are relatively deep and opaque such that the shelving units cast shadows upon or otherwise limit light from reaching merchandise stored on all but the top shelf of the shelving unit. Further, such lighting and shelving arrangements are bland and do not serve to "catch the eye" of retail customers and thereby attract the customer to particular items of merchandise.

Various lighting systems for shelving units have been employed to overcome these deficiencies, but they are often costly, laborious to assemble, and involve numerous electrical connections. Substantial skill is required to assemble such prior art lighting systems to eliminate the risk of electrical shock or even fire. Substantial routing of wires from light fixtures to a source of electricity is also required. After installation, dangling wires, unsightly lighting fixtures and electrical junctions detracts from achieving the desired effect.

A need therefore exists for a lighting system for shelving that is easy to install, is safe and that is unobtrusive.

SUMMARY OF THE INVENTION

The present invention includes (or is used in conjunction with) shelving units which comprise a base, one or more back members extending vertically from the base, and at least one shelf secured to the back member(s) and extending normally therefrom. Typically, the shelving units include a plurality of shelves supported by the back member(s) in a spaced, vertical arrangement.

The present invention comprises a lighting system that includes a lighting track. The track is secured to the back member of the shelving unit so it extends vertically from the base of the shelving unit toward the top of the shelving unit. The track has a channel with an elongate opening running along the length thereof and exposing a channel. Inside the channel, on opposite sides of the opening, are two parallel conductors also running the substantially the length of the channel and herein referred to as a track. A power supply, positioned out of sight in the base of the shelving unit, is operatively connected to the lighting track within or near the base of the shelving unit. The power supply is also electrically coupled to a standard electrical outlet. The standard electrical outlet, preferably located in the floor on which the shelving unit rests can be hidden by placing the base of the shelving unit over the outlet. The outlet, the power supply, the electrical connection between the power supply and the outlet and the electrical connection between the power supply and the track are generally hidden by the base and the bottommost shelf of the shelving unit.

One or more light fixtures are provided. Each light fixture includes a light assembly having at least one light source, an adapter and a wire lead comprising a cable containing conductive elements. The wire lead electrically couples the light assembly of the fixture to the adapter. The wire lead may be in the form of a harness or cable having connectors at the ends of the cable. One connector is used to couple the wire lead to the light source and another connector is used to couple the wire lead to the adapter. The designs of the connectors will depend on the designs of the adapters and light sources used. The light assembly of the fixture is mounted to one of the shelves of the shelving unit. The fixture is operatively (electrically) coupled via the adapter to the track proximate the shelf to which the light assembly is mounted.

One or more wire tracks or trays are also provided. The wire lead of a light fixture is routed through the wire track which extends perpendicularly from the lighting track either toward the front of the shelf or along the back of the shelf. The wire track is designed to be attached to the shelf and supports the wire lead to prevent it from dangling. When the wire lead is in the form of a harness, the wire lead and wire track can be joined together and the wire track attached to a shelf before the connectors of the wire lead is secured to the light source and/or adapter.

From the foregoing, it should be clear that difficult routing of wires is eliminated because the light fixtures are powered by the power supply via the hidden lighting track. Even the relatively short wire leads of the light fixtures are supported near the intersect between a shelf and the back member which is generally out of sight and the leads are kept from dangling by the wire tracks. The wire tracks not only support these wire leads, but also at least partially mask them from view.

The foregoing assembly provides an easy-to-install, safe, and effective way for lighting products placed on the shelves and is aesthetically pleasing.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
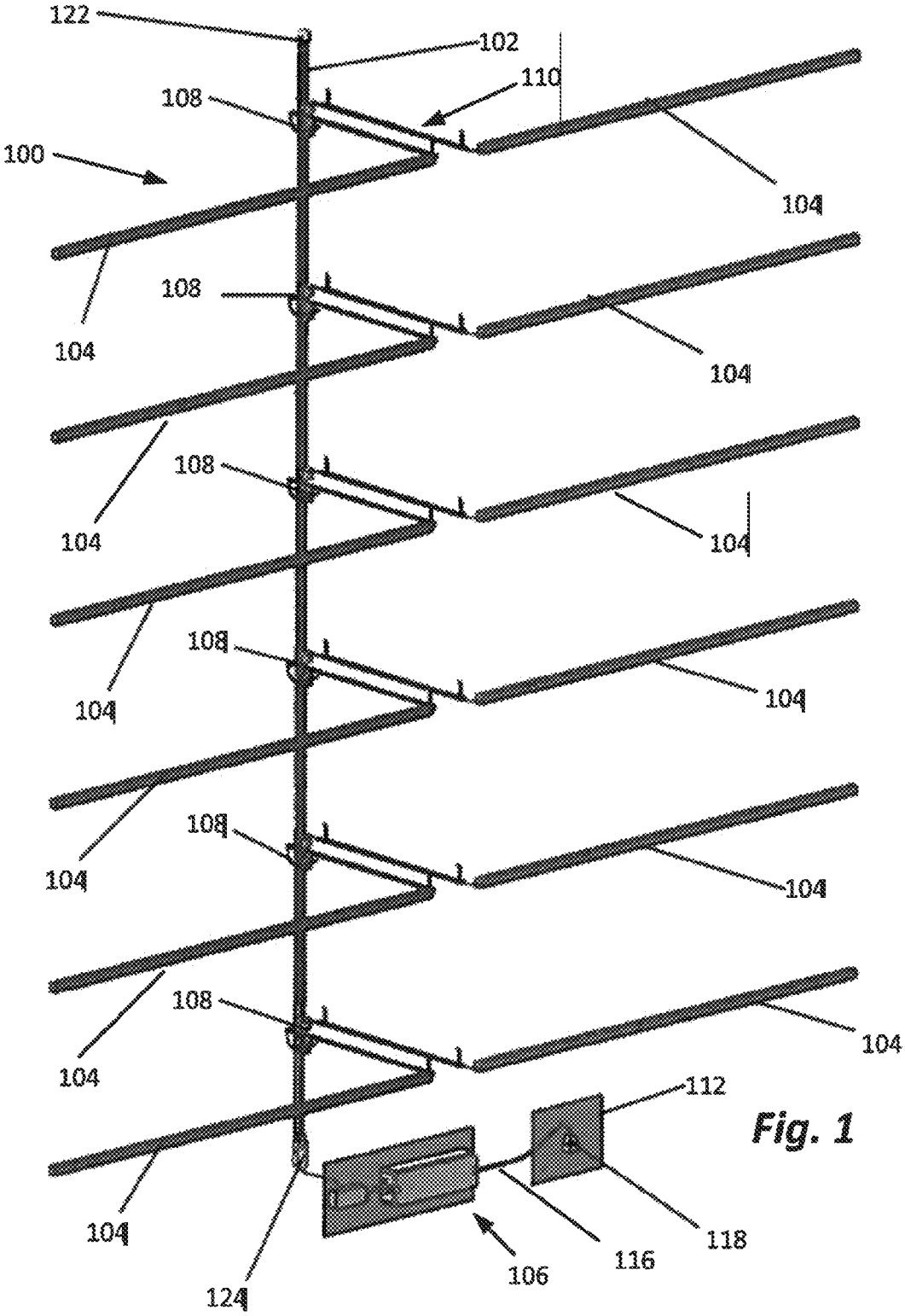
FIG. 1 illustrates a lighting system.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Shelving units and lighting systems which can be installed on shelving units are shown in the drawings, For example, such a lighting system can be installed on gondola-type shelving units. The lighting system can be provided with new shelving units or can be provided separately for installation onto existing shelving units.

FIGS. 2-5 and 6 illustrate a gondola-type shelving unit 200. As illustrated, the shelving unit 200 includes a hollow base 204 with an open top which rests upon a floor or other stable horizontal surface. The shelving unit also includes two or more back members 202. The back members 202 include a bottom and a top and a plurality of regularly spaced slots 203 (FIG. 5) positioned between the bottom and the top. The bottom of each back member 202 is secured to the base 204 such that the back members 202 extend upwardly in a vertical direction from the base 204. More specifically, the base 204 supports a plurality of the back members 202 in a parallel spaced apart arrangement. Panels (not shown) may also be provided at the back of the shelving unit 200 to close the space between the back members 202.

Figure 2:
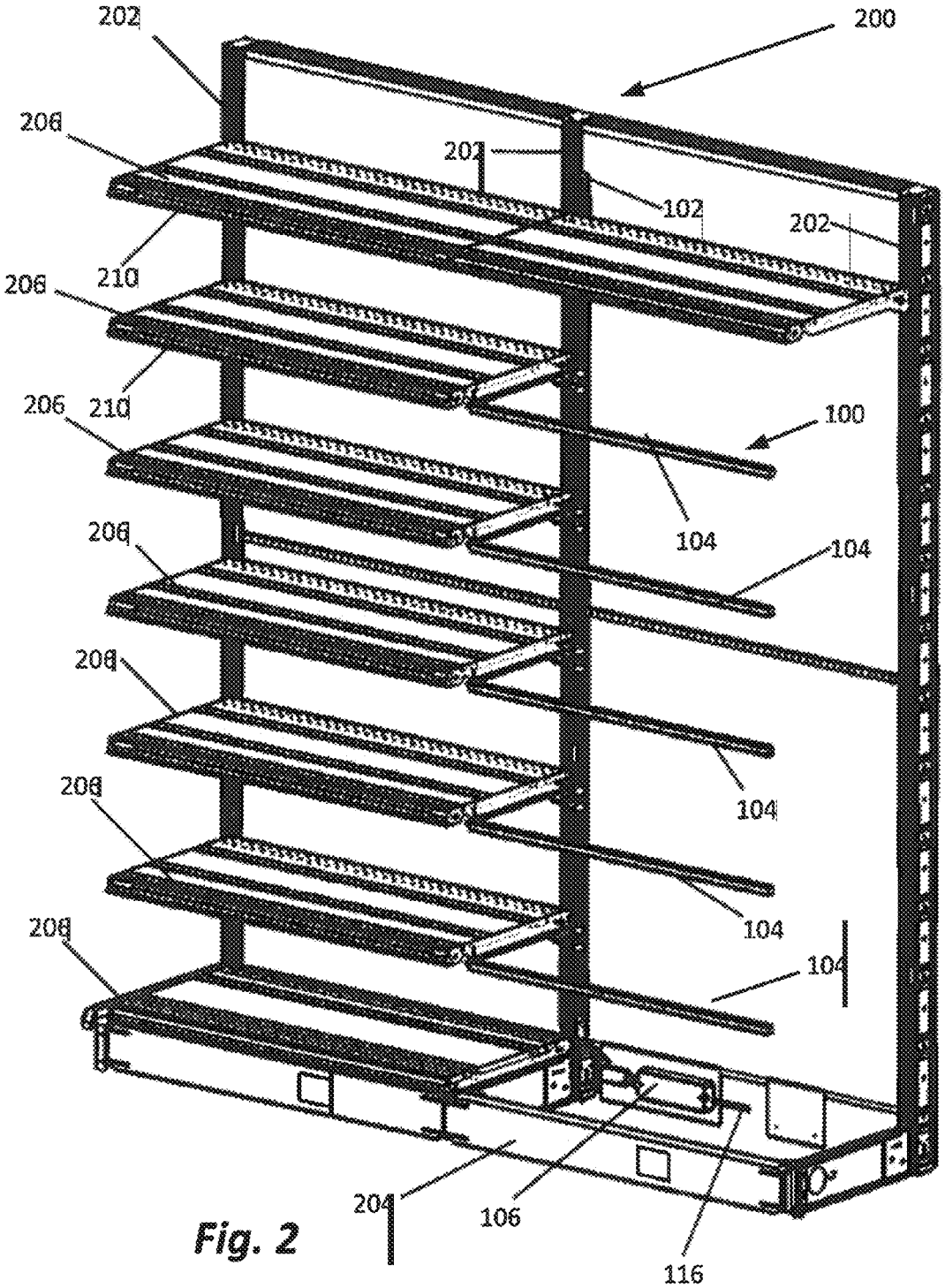
FIG. 2 illustrates the lighting system of FIG. 1 installed on a shelving unit.
Figure 5:
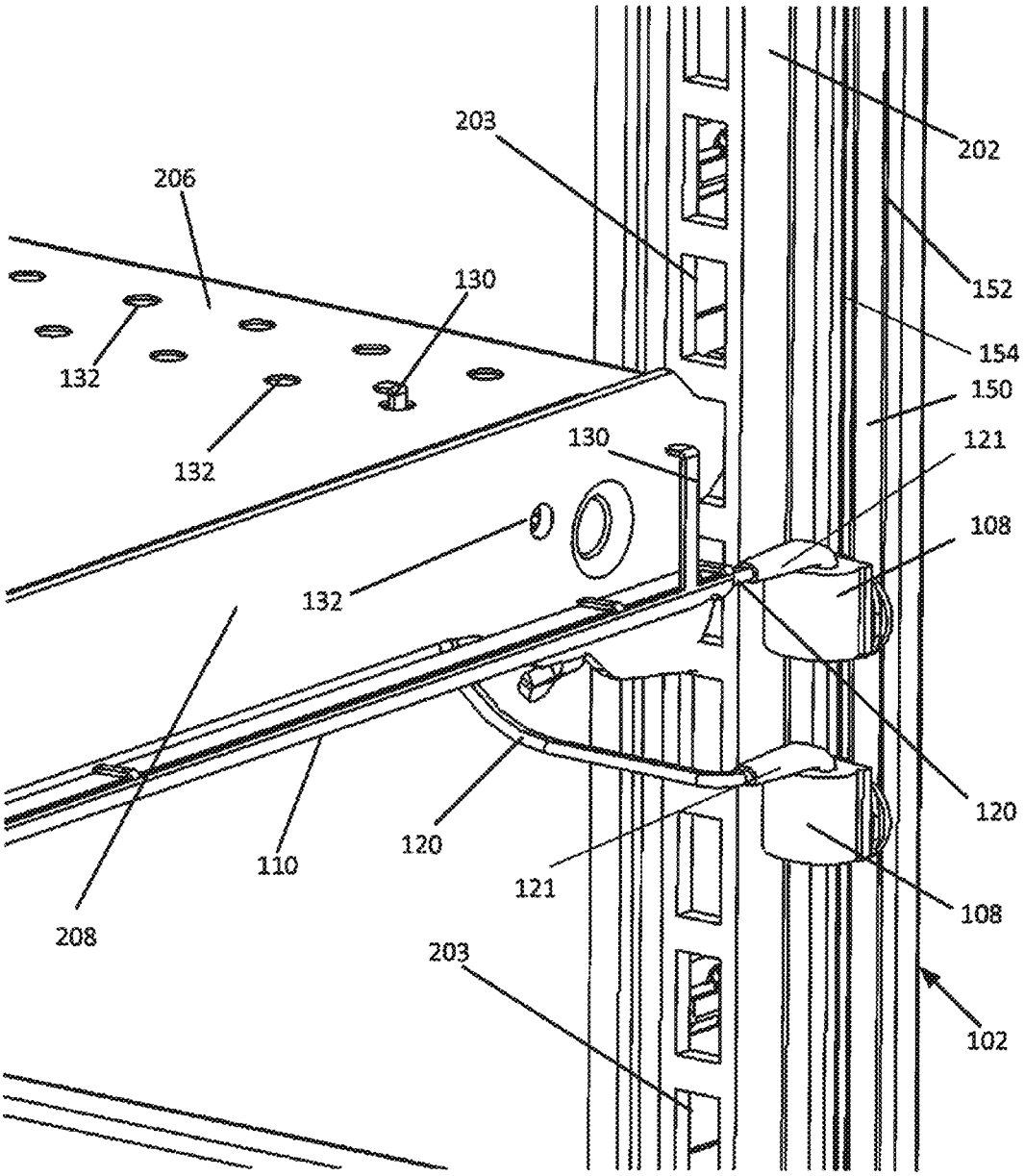
FIG. 5 illustrates a portion of a lighting system of FIG. 1 where the lighting system connects to a shelf of a shelving unit.
Figure 6:
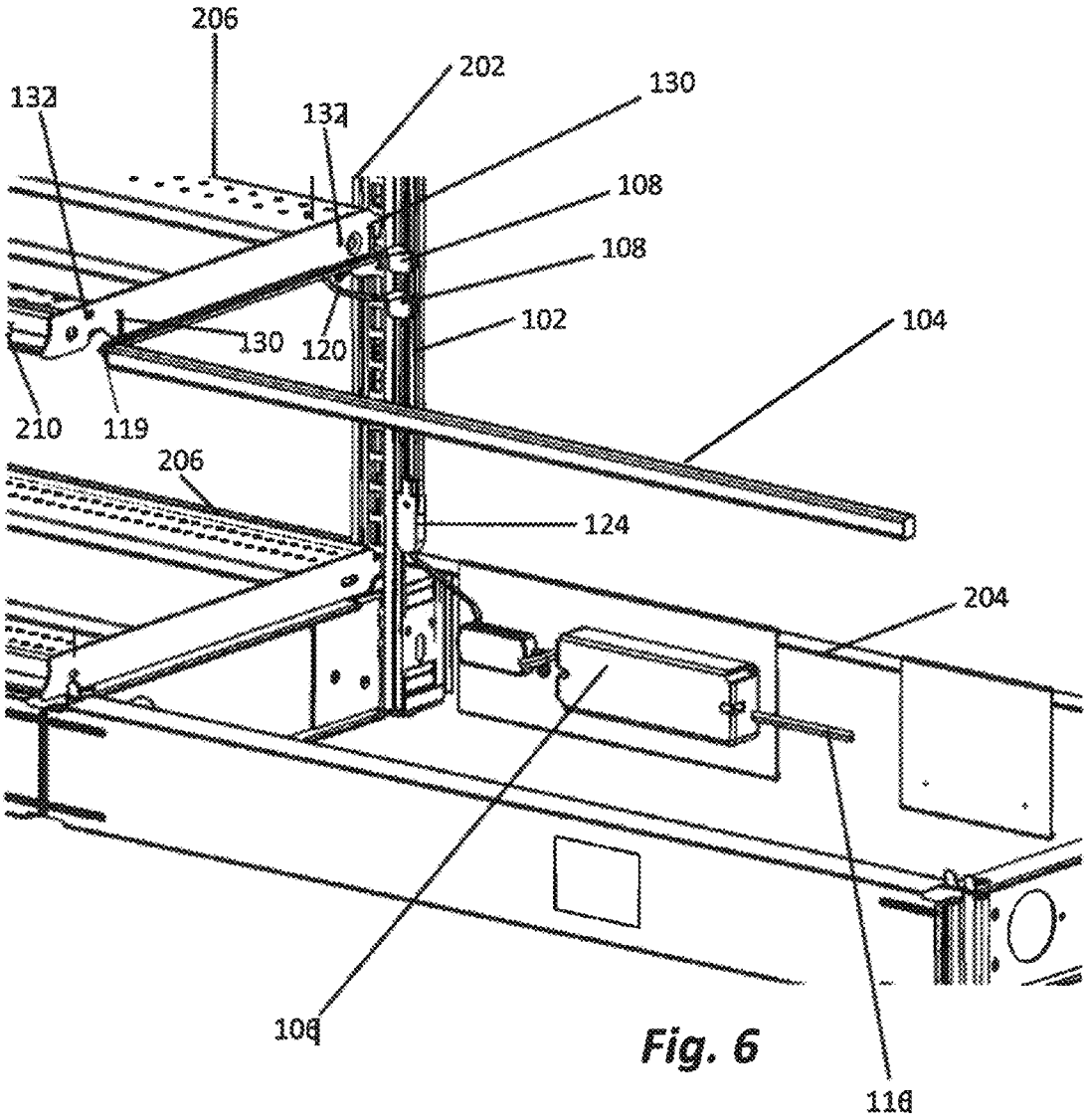
FIG. 6 illustrates a bottom portion of a lighting system of FIG. 1.

Gondola-type shelving units of the type illustrated in FIGS. 2, 5 and 6 also typically include a plurality of shelves 206. The shelves 206 extend horizontally between, and are supported by, a pair of the back members 202. The shelves are attached to the back members 202 by mating hooks on the shelves 206 with the slots 203 in the back members 202, as best shown in FIGS. 5 and 6. The height of the shelves 206 (the vertical distance between two adjacent shelves 206) will depend on the slots in the back members 202 to which the shelves 206 are mated. As shown in FIGS. 5 and 6, shelves 206 shown include a side 208, a bottom 210 and a plurality of holes 132 extending through the top and bottom, and through the side.

FIG. 2 shows a shelving unit having three back members 202 and two sets of vertically arranged, horizontal shelves 206. The number of sets of shelves can be increased by adding to the length of the base 204 and adding one or more back members 202. FIGS. 2 and 6 illustrate how the bottommost shelf 206 of each set can be affixed to back members 202 at a location immediately above the base 204 to conceal the contents of the base 204. In these drawings, the bottom shelf 206 of one of the two sets of shelves is not yet in place so that the contents of the base 204 can be viewed.

Now that an exemplary shelving unit 200 has been generally described, a lighting system 100 for lighting such a shelving unit 200 will be described with reference to the drawings.

As shown in the drawings, the lighting system 100 includes at least one power supply 106 operatively connected to an electrical outlet 114 (FIG. 3) by a power cable 116. As used herein, the term "operatively connected" should be understood that power, such as electrical power, is conveyed through the connection from one element to the connected element. In some situations, it is advantageous to provide a junction 118 along the length of the power cable 116 so that multiple power supplies 106 can receive electrical power from a single standard electrical outlet 114. As illustrated in the drawings, the electrical outlet 114 is in the building's floor such that the base 204 of the shelving unit 200 can be positioned to surround the electrical outlet 114. The power supplies 106 and junctions 118 are mounted to and within the base 204 and the power cords 116 likewise are within the base 204 such that when the bottom shelves 206 are all in place, the outlet 114, cords 116, power supplies 106 and junctions 118 are hidden or concealed from view. Mounting plates 112 (FIG. 1) may be used to couple the junctions 118 and/or power supplies 106 to the base 204 above the floor on which the shelving unit 200 rests.

Figure 3:
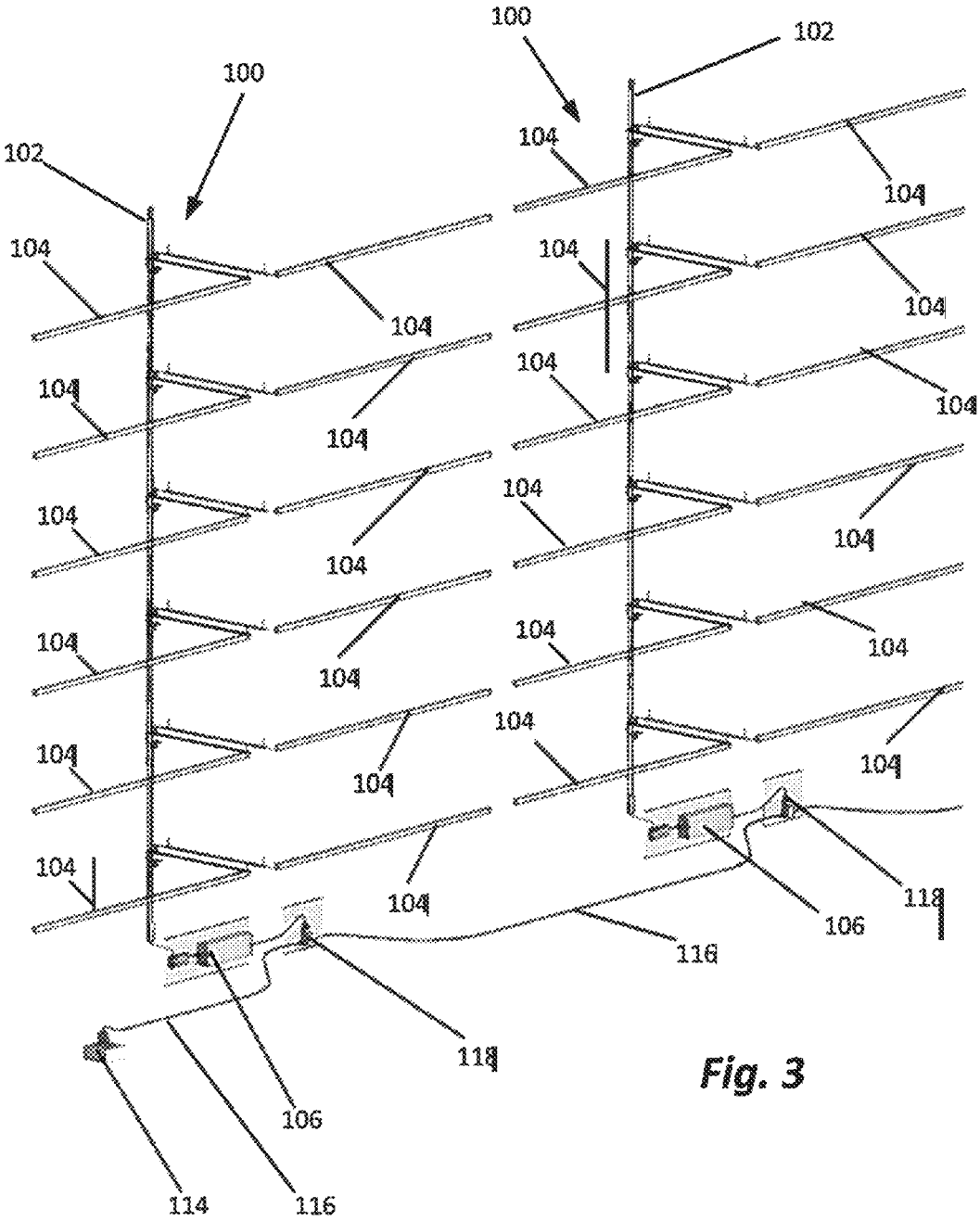
FIG. 3 illustrates two lighting systems of FIG. 1 which are interconnected.
Figure 4:
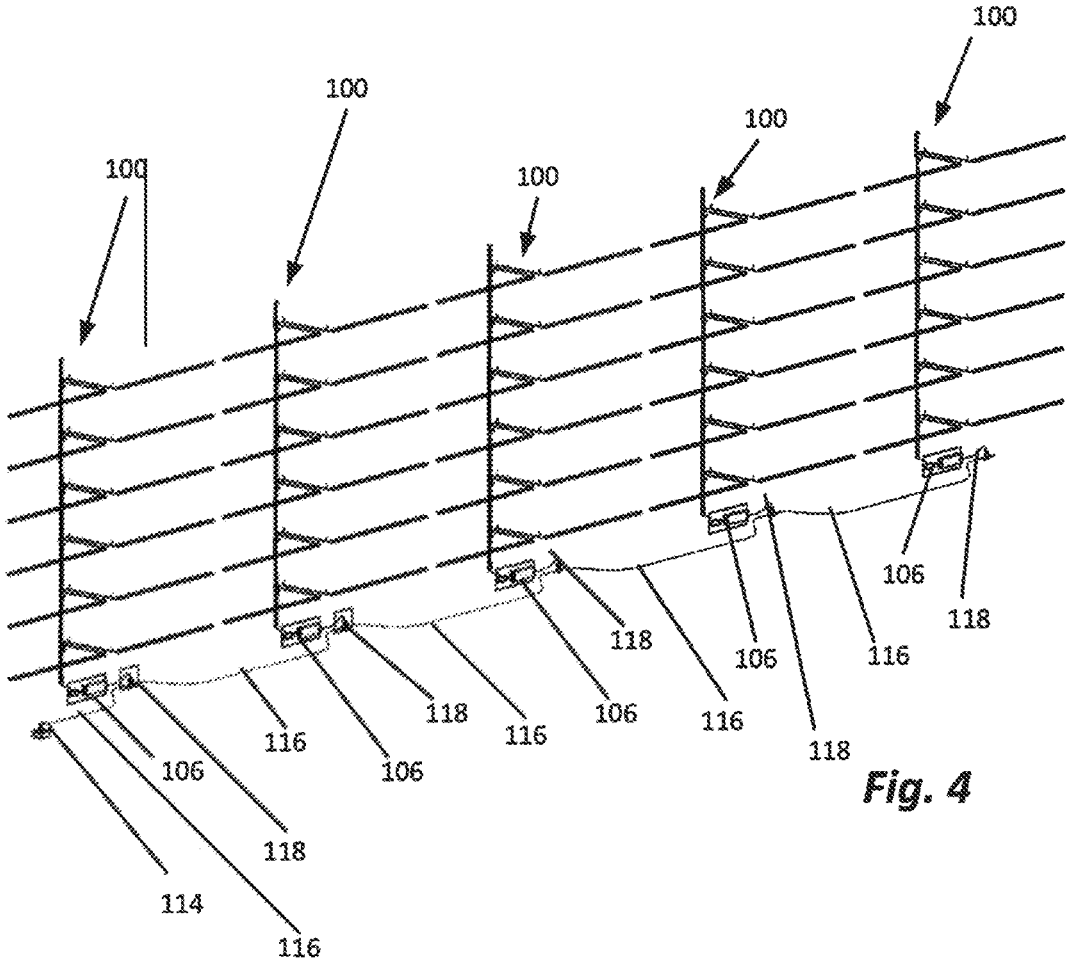
FIG. 4 illustrates five interconnected lighting systems of FIG. 1, which are interconnected.

The lighting system 100 also includes at least one lighting track 102 extending vertically adjacent to one of the back members 202. In FIG. 1, a single back lighting track 102 is shown. In FIG. 3, two lighting tracks 102 operatively coupled to two power supplies 106 are shown. FIG. 4 shows five lighting systems 100 each operatively coupled to a separate power supply 106 and track 102. All are attached to a single electrical cutlet 114 which is made possible by the provision of junctions 118 and power cords 116. All of the power supplies 106, junctions 118 and power cords 116 are preferably hidden within the base 204 of the shelving unit 200 below the bottom shelves 206 as previously explained. FIGS. 1, 3 and 4 demonstrate how the lighting systems can be used to illuminate shelving units 200 of differing lengths.

As illustrated in FIG. 1, each lighting track 102 has an end cap 122 and an end feed 124. The end feed 124 feeds electrical power from a power supply 106 to the lighting track 102. The end cap 122 electrically insulates the top end of the lighting track preventing inadvertent shocks to store employees and customers. The lighting track 102 may include a single length of track, or may include one or more pieces of track which can be operatively secured together by one or more conductive connectors. In some embodiments, each lighting track 102 is a low voltage mini-track such as tracks normally used for ceiling lighting. As best illustrated in FIG. 5, extending along the length of the lighting track is an opening or channel 150 defined by a pair of parallel lips 152, 154. Inside the channel 150 on each of the opposite sides of the opening is a parallel conductor (not shown).

In the case of a new shelving unit incorporating a lighting system, the lighting tracks 102 and the back members 202 may be integrally formed. Alternatively, a lighting track 102 may be attached to a back member 202 (or to a back panel) so that the conductive lighting track 102 extends vertically adjacent the back member 202. Suitable fasteners, such as adhesives, magnets, screws, or combinations thereof, may be used to secure a lighting track 102 to a back member 202 or back panel. In any event, the channel 150 in the lighting track 102 is parallel and in close proximity to the slots 203 in the back member 202. Since the electrical conductors of the lighting track 102 are operatively coupled to the power supply 106 via the end feed 124, electrical power is available along virtually the entire length of the lighting track 102. This arrangement is not only functional in terms of supplying power from the bottom to the top of the shelving unit 200, but does so in an aesthetically pleasing fashion without any dangling wires being visible.

The lighting system 100 also includes one or more light fixtures comprising a light assembly 104, an adapter 108, and a wire lead 120 (FIG. 5). The adapter 108 and wire lead 120 are used to operatively couple the light assembly 104 to the lighting track 102. The light assembly 104 can comprise a single light source such as an incandescent bulb or fluorescent tube. Alternatively, the light assembly 104 can include a plurality of light sources such as an LED light emitting diode rope, or an LED PCB (printed circuit board) strip.

The wire lead 120 comprises a cable, generally long enough to extend between the adapter 108 when coupled to the lighting track 102 and the light source 104 when coupled to the bottom 210 of a shelf 204. The wire lead 120 may be in the form of a harness having connectors 119 and 121 at opposite ends of the cable. The connector 119 is used to couple the wire lead 120 to the light assembly 104 and may be a quick connect/disconnect connector, the design of which will depend on the design of the light assembly 104 employed. Likewise, the connector 121 is used to couple the wire lead 120 to the adapter 108 and may also be a quick connect/disconnect connector, the design of which will depend on the design of adapter 108 employed. The adapter 108 may be coupled to the light track 102 in the same way that a low voltage ceiling track light fixture is coupled to a low voltage mini-track. The light assembly 104 may be coupled to the shelf 206, such as at underside 210 of a shelf 206 adjacent the front edge of the shelf in any suitable manner, including for example, with adhesives, magnets, spring clips, fasteners such as screws, or any combination thereof.

By way of example, FIGS. 5 and 6 illustrate two light fixtures being used to light two horizontally adjacent shelves, only the shelf of the left being shown in these drawings. More specifically, two adapters 108 are shown. The wire lead 120 coupled to the bottom adapter 108 carries power to a light assembly 104 (not shown) extending along the front edge of the shelf 206 on the left. The wire lead coupled to the top adapter carried power to a light fixture to be mounted to a shelf to be added on the right.

To keep the wire leads 120 from dangling, wire tracks or trays 110 are provided. The wire lead 120 is routed through or along a wire tray 110 as shown in FIGS. 5 and 6. Various mechanisms may be used to secure the wire tray 110 to the underside 210 of a shelf 206 including, adhesives, magnets and fasteners such as screws. Further, the wire trays 110 may be integrally formed with the shelves 206. Hooks 130 on the wire tray 110 are designed to mate with holes 132 in the shelf 206.

Such holes may extend through the shelf from the top to the bottom of the shelf when the wire track is positioned beneath the shelf 206. Such holes 132 may also be in the side 208 of the shelf and employed when the wire tray 110 extends along the side 208 of the shelf 206. FIG. 5 shows such a hook 130 extending up through a hole 132 extending between the top and bottom of the shelf 206.

Now that the basic components of the shelving unit 200 and the lighting assembly 100 have been described, their use and assembly will be further explained.

First, the base 204 of the shelving unit 200 is assembled and placed on the floor or some other suitable horizontal surface. Preferably, the base 204 is positioned so that it overlays an electrical outlet 114 in the floor, or adjacent to an electrical outlet 114 in a wall, to minimize the amount of power cord visible. Second, a plurality of back members 202 are attached to the back of the base 204 so that the back members 202 extend vertically and parallel to each other. The slots 203 in the back members 202 should be open to the front. If desired, back panels may also be added to close the back of the shelving unit 200.

Third, the desired number of power supplies 106, junctions 118, and power cords 116 are assembled and placed within the base 204. As illustrated in FIGS. 2 and 6, these components may be secured to the base 204 above the floor using plates such as 112.

Fourth, the lighting tracks 102 are secured so that they extend up from the base parallel to the back members 202. The opening of the channel 150 of the lighting tracks 102 faces the same direction as the slots in the back members 202. The lighting tracks 102 are then electrically coupled to the power supplies 106 using the end feeds 124. The insulating caps 122 are also attached to the light tracks 102. The bottom shelves 206 are then placed over the bases 204 to conceal the power supplies 106, junctions 118, and power cords 116.

Next, the remaining shelves 206 are arranged in spaced vertical relation by inserting the hooks extending from the back end of the opposite sides 208 of the shelves 206 into the desired slots 203 of adjacent back members 202 so that each shelf 206 is supported in a horizontal fashion by a pair of back members 202. In the drawings, such light assemblies 104 are attached along the underside of front edge of the shelves 206, but light assemblies 104 may also be attached to the shelves at different locations. The light assemblies 104 can be secured to the shelves 206 either prior to or after the shelves 206 are coupled to the back members 202.

Assembly continues by routing the wire leads 120 through the wire trays 110 or otherwise coupling the wire trays 110 to the wire leads 120. The wire trays 110 are secured to the shelves 206 to provide an aesthetically pleasing light display without any visible dangling wires. As shown in FIG. 5, the wire tracks are secured to the shelves 206 by mating the hooks 130 of the wire trays 110 with holes 132 in the shelves 206. This, again, can be done either before or after the shelves 206 are coupled to the back members 202.

Next, the adapters 106 of the light fixtures are coupled to the lighting track 102. When harness style wire leads 120 are employed, the connector 119 is coupled to the light assembly 104 and the connector 121 is coupled to the adapter 108. Electrical current is immediately delivered to the light assembly 104 from the light track 102 via the adapter 108 and wire lead 120.

As reflected in the drawings, the lighting system 100 is adaptable for use with shelving units having one or more vertically arranged sets of shelves 206. FIGS. 1 and 2 show a lighting system 100 adapted for two such sets of shelves 206. FIG. 3 contemplates four sets of shelves while FIG. 4 contemplates ten sets of shelves. Given the low power requirements of LED light sources, the lighting system 100 may be adapted for use with even more than ten sets of shelves 206. Also, there may be an odd number of sets of shelves 206. Further, not all shelves of a set of shelves need be illuminated by the lighting system 100. The lighting system 100 is adaptable to meet the wants and needs of the person assembling the shelving unit 200 and lighting system 100.

From the foregoing, it will be appreciated that although specific examples have been described herein for purposes of illustration, various modifications may be made without deviating from the spirit and scope of this disclosure. By way of further example, a timer or controller 300 may be provided between the electrical outlet and the lighting track to regulate the times the shelving is illuminated. Likewise, when multicolored or different colored LEDs are employed as the light source, a controller may be provided which controls the color of light cast by the lighting system at different points in time. For even further control, such controllers may be wirelessly coupled to a remote computer via a wireless network in which case the controllers) will have a microprocessor, memory, and wireless communications circuitry. It is, therefore, intended that the foregoing detailed description be regarded as illustrative rather than limiting, and that it be understood that it is the following claims, including all equivalents, that are intended to identify the invention.

What is claimed is:

1. A lighted shelving unit comprising:

(a) a shelving unit including (i) a hollow base with an open top; (ii) a vertical back member extending upwardly from the base; (iii) a first horizontal shelf covering the open top of the base; and (iv) a second horizontal shelf coupled to the back member in spaced apart relation to the first shelf; and (b) a lighting system including (i) a first vertical lighting track secured to the back member; (ii) a second vertical lighting track; (iii) a first power supply located within the hollow base of the shelving unit and adapted to be operatively connected to the first vertical lighting track; (iv) a second power supply located within the hollow base of the shelving unit and adapted to be operatively connected to the second vertical lighting track; (v) a first junction located within the hollow base and adapted to be operatively coupled to a standard electrical outlet via a power cord and to each of said first and second power supplies; (vi) at least one wire tray coupled to the second shelf; (vii) at least one first light fixture including a light assembly coupled to the second shelf, an adapter operatively connected to said first vertical lighting track, and a wire lead routed along the wire tray and operatively connecting the adapter to the light assembly; and (viii) at least one second light fixture including a light assembly, an adapter operatively connected to said second vertical lighting track, and a wire lead operatively connecting the adapter to the light assembly.

2. The lighted shelving unit of claim 1 wherein the power supplies are secured to the base of the shelving unit.

3. The lighted shelving unit of claim 1 wherein at least one of said first and second lighting tracks of the lighting system are integrally formed with the back member.

4. The lighted shelving unit of claim 1 further comprising a second junction located in the hollow base and connected via cables to said first junction and said second power supply to operatively couple said second power supply to said first junction.

5. The lighted shelving unit of claim 1 wherein the wire lead of said at least one first light fixture is routed along the wire tray and the wire tray extends perpendicular to the first vertical lighting track.

6. The lighted shelving unit of claim 1 wherein the shelving unit includes a plurality of second shelves secured to the back member at spaced intervals along a vertical length of the back member.

7. The lighted shelving unit of claim 6 wherein the lighting system includes at least one light assembly for each second shelf.

8. The lighted shelving unit of claim 6 wherein the lighting system includes a plurality of adapters located at spaced intervals along a length of the first vertical lighting track that correspond to the spaced intervals at which the second shelves are secured along the vertical length of the back member, with at least one adapter being located at each interval.

9. The lighted shelving unit of claim 1 wherein the second horizontal shelf has a front edge and the light assembly of said at least one first light fixture is secured adjacent to the front edge of the second horizontal shelf.

10. The lighted shelving unit of claim 1 wherein the second horizontal shelf has a underside and the light assembly of said at least one first light fixture is secured adjacent to the underside of the second horizontal shelf.

* * * * *